United States Patent [19]

Rice

[11] 4,311,025

[45] Jan. 19, 1982

[54] GAS COMPRESSION SYSTEM

[75] Inventor: Warren Rice, Tempe, Ariz.

[73] Assignee: Natural Energy Systems, Tempe, Ariz.

[21] Appl. No.: 121,666

[22] Filed: Feb. 15, 1980

[51] Int. Cl.[3] ..... F25B 1/00; F04F 11/00

[52] U.S. Cl. ..... 62/502; 62/114; 417/67

[58] Field of Search ..... 62/115, 467, 502, 114; 417/66, 67, 72

[56] References Cited

U.S. PATENT DOCUMENTS

| | | | |
|---|---|---|---|
| 2,025,037 | 12/1935 | Bergmann | 417/67 |
| 2,232,839 | 2/1941 | Carter | 417/66 X |
| 3,277,659 | 10/1966 | Sylvan et al. | 62/502 X |
| 4,078,392 | 3/1978 | Kestner | 62/502 X |

*Primary Examiner*—William E. Wayner

*Attorney, Agent, or Firm*—Cahill, Sutton & Thomas

[57] ABSTRACT

A multiple disk compressor has a through flow of a two-phase medium consisting of gas bubbles entrained in a non-miscible liquid carrier and causes an almost isothermal compression of the gaseous phase of the medium. Because of the larger density at a given tip speed, much higher pressure ratio is obtained in a single stage than can be obtained in a conventional compressor having a throughflow of gas only. The liquid carrier, after separation from the compressed gaseous medium, provides heat to a heat exchanger before being reduced in pressure and returned to the compressor. The separated gaseous medium under pressure is withdrawn as the useful product. Where the compressor is a part of a refrigeration system and the gaseous medium is a refrigerant, the compressed gaseous medium, which is transformed to a liquid state by the compressor, flows through an expansion valve to reduce its pressure and temperature, an evaporator to cool a medium, such as air, and is returned to the compressor for re-entrainment in the liquid carrier.

6 Claims, 2 Drawing Figures

GAS COMPRESSION SYSTEM

Figure 1:
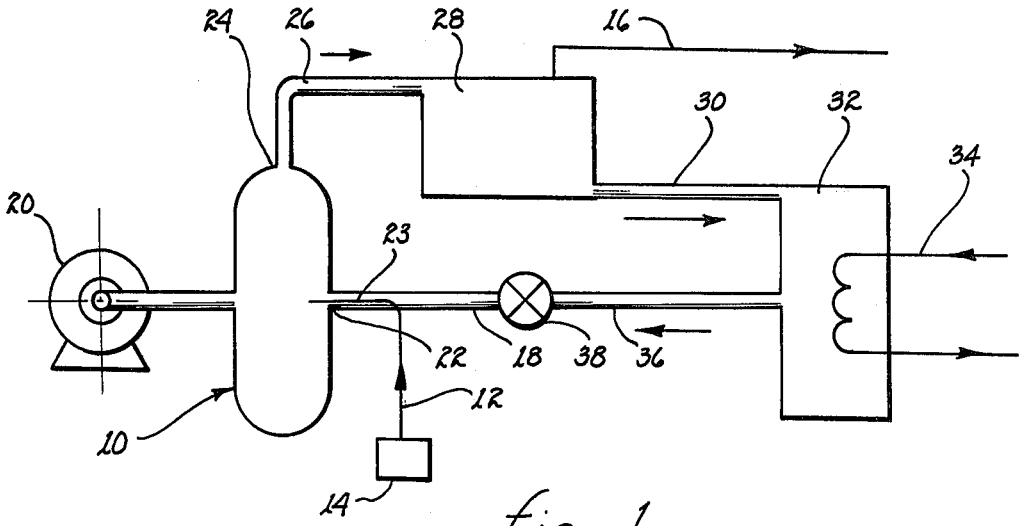

The present invention relates to systems for compressing gas and, more particularly, to systems employing centrifugal pumps or compressors for compressing liquid entrained gases.

The basic concepts attendant the construction and operation of multi-disc pumps and compressors are described in U.S. Pat. Nos. 1,061,142 and 1,061,206 issued to Nikola Tesla in 1913. Since that time, studies of varying scope have been conducted from time to time by diverse individuals in this country and various foreign countries. Their work and the state of the art to date are referenced in two technical papers prepared by the present inventor and entitled "An Analytical and Experimental Investigation of Multiple Disk Pumps and Compressors", published in July, 1963 in the *Journal of Engineering for Power* and "Calculated Design Data For the Multiple-Disk Pump Using Incompressible Fluid", published in the *Journal of Engineering for Power,* Transaction of ASME, volume 96, Series A, No. 3, July, 1974, pages 274–282.

Despite the many highly technical studies performed on multiple disk pumps and compressors, very little has been done to exploit commercial uses of such pumps and compressors. The reasons therefor are not presently completely understood. However, the present inventor has learned through his studies, experiments and investigations that multiple disk pumps and compressors are extremely well suited for entraining a gaseous medium to be compressed within a non-miscible fluid enabling very high pressure ratios for the gas to be achieved at low rotor tip speed in a single stage as compared with the pressure ratios of conventional gas compressors. The degree of compression may be varied within limits by simply varying the rotational speed of the multiple disks. The known prior art appears devoid of these teachings.

It is therefore a primary object of the present invention to provide apparatus for compressing a gaseous medium within a non-miscible liquid carrier in a centrifugal compressor.

Another object of the present invention is to provide a source of gas under pressure by compressing and separating a mixture of non-miscible gas and liquid.

Still another object of the present invention is to provide a multiple disk compressor for entraining and compressing a gas within a liquid carrier.

Yet another object of the present invention is to provide a moderate vacuum by withdrawing a gaseous medium through entrainment of the gaseous medium in a non-miscible liquid carrier.

A further object of the present invention is to provide a refrigeration system having centrifugal compressor, such as a multiple disk compressor, for compressing the refrigerant, entrained in a non-miscible liquid carrier.

A still further object of the present invention is to provide a means for regulating the cooling effect of a refrigeration system by varying the degreee of compression of the refrigerant above a minimum pressure and/or by varying the ratio of the refrigerant to the non-miscible liquid carrier.

A yet further object of the present invention is to provide a low cost, low maintenance centrifugal compressor for refrigeration systems.

These and other objects of the present invention will become apparent to those skilled in the art as the description thereof proceeds.

Figure 2:
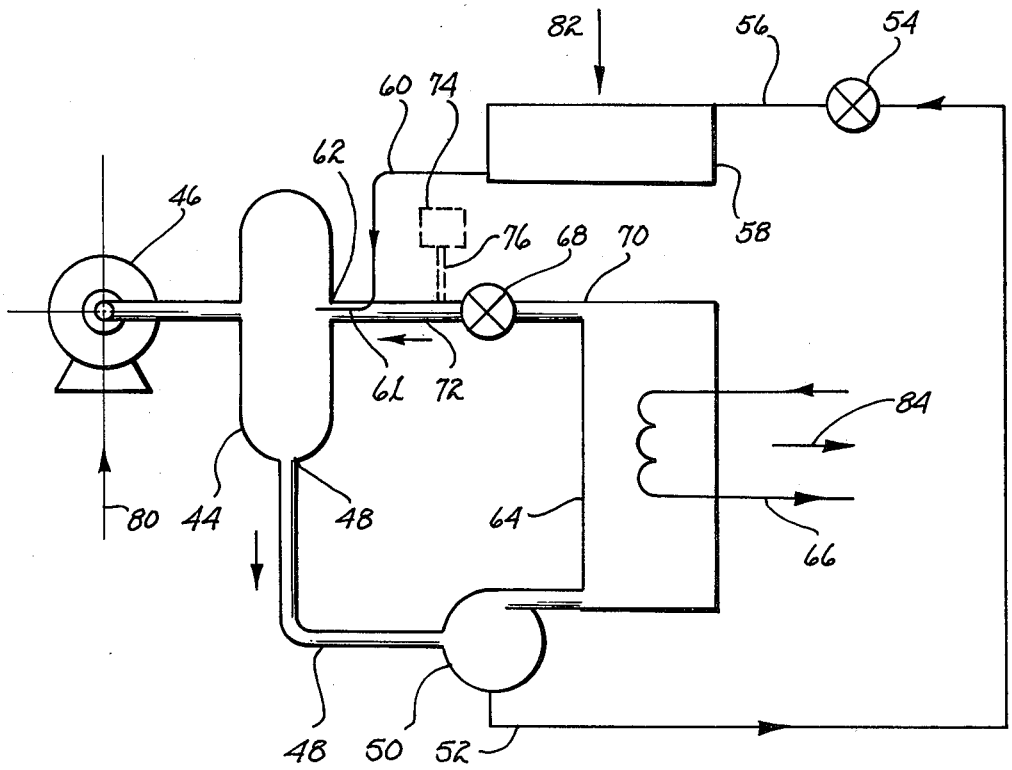

The present invention may be described with greater specificity and clarity with reference to the following drawings, in which:

FIG. 1 is a schematic illustrating apparatus for compressing a gaseous medium by employing a two-phase compressor; and FIG. 2 is a schematic illustrating a refrigeration system employing a two-phase compressor.

Referring to FIG. 1, there is shown a compressor 10 for compressing a gaseous medium conveyed to inlet 22 through pipe 12 to inlet 22 from a source 14 and discharging the compressed gas through a pipe 16. While the term "compressor" is used in conjunction with the apparatus referenced by numerals 10 and 44, devices more aptly called pumps may also be employed. It is to be understood that the gas may be air, in which case source 14 may be ambient air. In addition to the inflow of gas, a liquid carrier is introduced to the compressor inlet through conduit 18, which liquid carrier in non-miscible with the gas.

The compressor may be any of the type known generically as a "centrigual pump" or "centrifugal compressor"; however, in the preferred embodiment of the present invention, the species known as a "multiple disk compressor" will be described. These compressors have the advantage of a large pressure rise in one stage. A multiple disk compressor, as is definitively reviewed in the referenced prior art, includes a multiple disk rotor consisting of a number of thin, smooth, flat parallel disks arranged normal to a rotatable shaft and fastened rigidly to it with small spaces between the disks. Holes or slots are provided in the disks near the shaft; alternatively, the shaft may be hollow. A housing encapsulates the disk rotor and includes an inlet proximate the shaft and an outlet proximate the periphery of the disk rotor.

In operation, a fluid enters the compressor through the holes or slots near the shaft or through the shaft, if hollow, and flows therefrom into the spaces between the disks in an approximately radial direction. Because of the shear stress exerted on the fluid by the disks, the fluid is accelerated tangentially which in turn causes centrifugal forces which accelerate the fluid radially toward the disk periphery. Consequentialy, the fluid follows in a spiral path relative to a fixed coordinate system while between the disks and exhausts into a diffusion scroll at a high velocity with both radial and tangential components. During passage through the disk rotor, the fluid reacts on the multiple disk system requiring that external torque be supplied to the shaft by a driving engine or motor such as electric motor 20. The fluid exhausts from the diffusion scroll at a higher energy then that at which it enters the compressor, the increased energy being primarily in the form of enthalpy. The net useful result is an increase in the pressure of the fluid between the compressor inlet and outlet. Preferrably, the electric motor includes speed control means whereby the rotational speed of the disk rotor may be varied to vary the degree of pressure, above a predetermined minimum, at the outlet of the compressor.

Both the gas to be compressed and the liquid carrier are introduced to inlet 22 of compressor 10 proximate the shaft and center of the rotor disks. The gas is mixed with the liquid carrier in the form of very tiny bubbles which become easily entrained and the mixing may be through a perforated pipe distributor, known as a sparger and indentified by reference numeral 23. The sparger may be proximate inlet 22 or upstream thereof, as illustrated. The entrained gas bubbles travel through the disk rotor and as they travel radially they are compressed as the pressure of the entraining liquid carrier increases radially. During compression, the gas bubbles transfer energy as heat to the surrounding liquid carrier very rapidly and efficiently because of their very small size. Accordingly, the compression process is virtually isothermal. It may be noted that an isothermal gas compression process is preferred but is very difficult to approach in conventional gas compressors.

The pressurized mixture of gas and liquid carrier exits through outlet 24 after passing through the diffusion scroll of the compressor and is conveyed through conduit 26 to separator 28. The separator serves to segregate the gas bubbles from the liquid carrier. It may be passive whereby the bubbles rise to the top of the liquid carrier and are gravitationally separated therefrom or separation may be effected in a type known as a "cyclone separator". Alternatively, separation may be effected by a motor driven centrifugal separator of which many commercial embodiments exist.

The compressed gas is removed from separator 28 through pipe 16 as the useful product. The liquid carrier is conveyed from separator 28 through pipe 30 to a heat exchanger 32. Heat from the liquid carrier is transferred to the medium flowing through coils 34 within the heat exchanger.

The cooled liquid carrier flows from the heat exchanger through pipe 36 to a throttling valve 38 which reduces the pressure of the liquid carrier to a predetermined value. The liquid carrier is returned to inlet 22 through conduit 18.

As the throttling valve produces no useful work other than of reducing the pressure of the liquid carrier, a turbine or similar engine can be substituted to develop augmental power to assist in driving the compressor.

The above described system has several advantages over conventional well known gas compression systems. First, it provides an increased energy conversion efficiency resulting from the isothermal gas compression. Second, the initial costs and maintenance costs of the compressor are relatively low as the compressor may operate at low speed and at a lower temperature than equivalent conventional compressors having the same pressure ratio. Third, the gas can be maintained free of contamination by oil or other lubricants and fluids necessary in conventional compressors. Fourth, experiments indicate that the compressed gas will usually have less absolute humidity on leaving the compressor than it has on entering even though the liquid carrier is water; if the liquid carrier is not water, a water trap may be necessary to eliminate water condensed by compression of the air by the system.

One of the important attributes of the gas compression system employing a multiple disk compressor is that the average density of the mixture of liquid and gas within the disk rotor is very much greater than that of the gas alone in a conventional gas compressor. Thus, the pressure ratio that can be obtained in a single stage of compression is higher since the ratio is proportional to the density of the compressed medium. This produces the beneficial effects of enabling the disk rotor to be small or run at low speed relative to equivalent conventional compressors and yet provide an equivalent pressure ratio.

Aside from employing the above described system to provide a source of compressed gas, the system may be employed as a vacuum pump for moderate vacuum applications. Herein, pipe 12 would be connected to the envelope or chamber to be evacuated. The pressure to which the envelope is to be reduced is regulated by throttle valve 38 to lower the pressure of the liquid carrier below that of the gas in pipe 12 and draw the gas from the envelope into compressor 10. After separation of the gas and liquid carrier, the gas may be discharged to the atmosphere. To avoid boiling of the liquid carrier at input 22, it is preferable that the liquid carrier have a suitably large vapor pressure, such as petroleum oil or silicone oil.

FIG. 2 illustrates a variant of the above-described system adapted to a refrigeration system. A centrifugal compressor 44, such as a multi-disk compressor, is driven by a power source, such as electric motor 46. A mixture of refrigerant and non-miscible liquid medium or liquid carrier is expelled through outlet 48 of the compressor at a pressure greater than the "saturation pressure" of the refrigerant commensurate with the temperature of the mixture. Accordingly, the refrigerant entrained within the liquid carrier will be in the form of a myriad of tiny liquid droplets. As with the system described with respect to FIG. 1, the compression process within compressor 44 is essentially isothermal.

The mixture flows from outlet 48 through conduit 49 to separator 50. The separator may be either active or passive. If passive, and as the refrigerant is generally more dense than the liquid carrier, the refrigerant may be withdrawn from the bottom of the separator through pipe 52. The refrigerant, in liquid form, is transported through expansion valve 54 wherein it experiences a substantial pressure and temperature drop and becomes a "quality mixture" of vapor and liquid. The quality mixture flows through pipe 56 into a conventional evaporator 58. In the evaporator, the refrigerant absorbs heat from the medium to be cooled and becomes a slightly super heated vapor. The gaseous refrigerant is conveyed through pipe 60 to sparger 61 disposed at inlet 62 of compressor 44.

The liquid carrier flows from separator 50 to heat exchanger 64. Within the heat exchanger, heat is transferred from the liquid carrier to a cooling medium flowing through coils 66. The cooled liquid carrier is conveyed from the heat exchanger to throttling valve 68 by pipe 70. The throttling valve reduces the pressure of the liquid carrier to a predetermined value and it is conveyed to inlet 62 of compressor 44 through pipe 72.

For reasons stated above, the multi-disk compressor will compress the liquid carrier along with the bubbles of refrigerant contained therein. The resulting compression of the bubbles to an increasing pressure will convert the refrigerant from a gaseous state to a liquid state and the bubbles become liquid droplets entrained within the liquid carrier. Accordingly, compressor 14 performs the dual function of compressing the refrigerant and serving as a condenser. Moreover, because of the exceptional dispersion of the refrigerant throughout the liquid carrier, the heat generated by compression of the refrigerant will be rapidly dissipated to the liquid carrier to produce an essentially isothermal compression of the refrigerant.

The refrigerant may be a fluorocarbon, such as one of the family known as "freon", but other refrigerants can be used. Preferably, the refrigerant should be no more than slightly soluble and immiscible in the liquid carrier and it should have a density in its liquid state which is significantly different from that of the liquid carrier. In example, the liquid carrier may be water but other carriers may have an advantage in some applications.

To accommodate volumetric variations of the refrigerant under load, an expansion or surge tank 74 may be employed. Preferably, such a tank is connected by pipe 76 intermediate throttling valve 68 and inlet 62 and includes a gas space, the pressure of which is variable by a control system to vary the inflow and outflow commensurate with volumetric changes of the refrigerant.

As with the embodiment described in FIG. 1, throttling valve 68 may be replaced by a turbine or similar work producing element in order to provide both a reduction in pressure and a work output. The work output may be employed to augment the power inflow to compressor 44 or to drive other related equipment.

Several advantages arise from using a multi-disk compressor rather than a conventional compressor in a refrigeration system. First, the initial cost is lower than comparable capacity conventional compressors and maintenance costs are lower as the only moving part is the shaft mounted multiple disk. Second, hermetic sealing, as is necessary for conventional refrigerant compressors, can be avoided. Third, the MTBF (mean time between failure) should be greater than conventional compressors as compressor 44 can operate at relatively low rotational speed and is not subjected to the temperature variations required at a condenser of a conventional system.

Conventional refrigeration systems are operationally regulated to maintain a constant temperature by cycling the compressor on and off. In the refrigeration system illustrated in FIG. 2, such cycling is unnecessary as the extent of refrigeration available is regulatable by varying the rotational speed of the multi-disk rotor, provided a determinable minimum rotational speed is maintained. Moreover, the degree of refrigeration can also be maintained by varying the ratio of refrigerant to liquid carrier. Alternatively, both the rotational speed and ratio can be varied to obtain fine tuned temperature control. These benefits permit achievement of certain economies in terms of sizing the compressor capacity commensurate with the refrigeration load expected.

As may be deduced from the above description of the variant illustrated in FIG. 2, it operates as a refrigeration cycle in the conventional thermodynamic sense. That is, work is added by electric motor 46, as indicated by arrow 80; heat is added at evaporator 58, as indicated by arrow 82; and heat is rejected at heat exchanger 64, as indicated by arrow 84. Accordingly, the refrigeration system operates in accord with the first and second laws of thermodynamics.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. Apparatus for compressing a gaseous medium, said apparatus comprising in combination:

(a) a source of the gaseous medium;

(b) a liquid medium for entraining the gaseous medium, said liquid medium being non-miscible with the gaseous medium;

(c) a sparger for distributing the gaseous medium within said liquid medium to entrain the gaseous medium in said liquid medium;

(d) a multiple disc compressor for compressing said liquid medium and the entrained gaseous medium, said compressor including an inlet in communication with said sparger for receiving said liquid medium and the entrained gaseous medium and an outlet for discharging said pressurized liquid medium and the entrained gaseous medium, said compressor including:

(i) means for applying power to said compressor to rotate said compressor;

(ii) means for varying the compression of said liquid medium and entrained gas medium and regulating the speed of rotation of said compressor; and (iii) means for varying the ratio of the gaseous medium to said liquid medium;

(e) a separator in fluid communication with said outlet for separating the pressurized gaseous medium from said liquid medium;

(f) means for withdrawing heat from said liquid medium; and (g) means for reducing the pressure of said liquid medium and for returning said liquid medium to said sparger.

2. The apparatus as set forth in claim 1 wherein said pressure reducing means includes means for reducing the pressure below ambient pressure.

3. The apparatus as set forth in claim 1 wherein said pressure reducing means comprises a throttling valve disposed downstream of said heat exchanger.

4. A refrigeration system including a refrigerant and a liquid carrier non-miscible with the refrigerant, said refrigeration system comprising in combination:

(a) a sparger for distributing the gaseous refrigerant within the liquid carrier to entrain the gaseous refrigerant in the liquid carrier;

(b) a multiple disk compressor for compressing the liquid carrier and the entrained refrigerant, said compressor including an inlet for receiving the liquid carrier and entrained refrigerant and an outlet for discharging the liquid carrier and entrained refrigerant, said compressor including:

(i) means for applying power to said compressor to rotate said compressor;

(ii) means for varying the compression of the liquid carrier and the entrained refrigerant and regulating the speed of rotation of said compressor; and (iii) means for varying the ratio of the refrigerant to the liquid carrier;

(c) a separator for separating the liquid refrigerant from the liquid carrier;

(d) means for reducing the temperature and pressure of the refrigerant downstream of said separator;

(e) means for transfering heat from a medium to be cooled to the refrigerant and returning the refrigerant to said sparger;

(f) means for withdrawing heat from the liquid carrier downstream of said separator; and (g) means for reducing the pressure of the liquid carrier and returning it to said sparger.

5. The refrigeration system as set forth in claim 4 including means for varying the pressure of the refrigerant by varying the speed of rotation of said compressor to correspond with the imposed refrigeration load.

6. The refrigeration system as set forth in claim 4 including a surge tank for accommodating volumetric variations of the refrigerant within said refrigeration system.

* * * * *